US006463593B2

(12) United States Patent
Cotten

(10) Patent No.: US 6,463,593 B2
(45) Date of Patent: Oct. 15, 2002

(54) SAFETY SHOULDER STRAPS FOR HIGH TROUSERS INTEGRATING A LIFE JACKET

(75) Inventor: Guy Cotten, Concarneau (FR)

(73) Assignee: Etablissements Guy Cotten, Tregunc (FR)

( * ) Notice: Subject to any disclaimer, the term of this patent is extended or adjusted under 35 U.S.C. 154(b) by 0 days.

(21) Appl. No.: 09/832,963

(22) Filed: Apr. 12, 2001

(65) Prior Publication Data

US 2001/0055925 A1 Dec. 27, 2001

(30) Foreign Application Priority Data

Apr. 12, 2000 (FR) ..... 00 04730

(51) Int. Cl.[7] ..... A41D 1/06
(52) U.S. Cl. ..... 2/227; 2/DIG. 3; 441/88
(58) Field of Search ..... 2/227, 79, 69, 2/94, 85, 93, 108, 50–52, 310, 229–230, 913, DIG. 3; 441/87, 88, 102, 107–108, 116–118, 121

(56) References Cited

U.S. PATENT DOCUMENTS 4,184,216 A 1/1980 Saleen
5,754,982 A * 5/1998 Gainer ..... 2/2.5
5,806,095 A * 9/1998 Cotten ..... 2/79

FOREIGN PATENT DOCUMENTS

| | | |
|---|---|---|
| DE | 32 22 225 | 12/1983 |
| FR | 2 736 513 | 1/1997 |
| GB | 1 540 924 | 4/1979 |
| GB | 2 250 482 | 6/1992 |
| GB | 2 268 387 | 1/1994 |
| JP | 9 301 272 | 11/1997 |

* cited by examiner

*Primary Examiner*—Gloria M. Hale
*Assistant Examiner*—Tejash Patel
(74) *Attorney, Agent, or Firm*—Young & Thompson

(57) ABSTRACT

The safety straps for high trousers integrates a life jacket, wherein the life jacket is integral with a belt by at least one belt fastener, the trousers comprise at least one front flap and are held in position by the straps. The straps are U-shaped and include a cover and the life jacket enveloped between an internal layer and an external layer of the cover. The straps are fixed toward the top of the flap by two removable antero-lateral fasteners connected on the external layer of the cover at a distance from the extremities of both branches of the U. The straps at the rear are fixed toward the top of the trousers by at least one removable postero-median fastener connected to the base of the U provided on the rear and lateral sections of the user's neck. The trousers include at the waist loops intended for accommodating the belt.

20 Claims, 2 Drawing Sheets

SAFETY SHOULDER STRAPS FOR HIGH TROUSERS INTEGRATING A LIFE JACKET

FIELD OF THE INVENTION

This invention relates to safety shoulder straps for high trousers, wherein the shoulder straps integrate a life jacket. These shoulder straps are intended to suit work dresses or high trousers used by professional seamen, high sea navigators, regatta sailors or fresh water ferrymen.

BACKGROUND OF THE INVENTION

Inflatable safety life jackets in the shape of inverted U's are already known. This type of life jacket is placed around the user's neck and both U-shaped parallel branches are arranged on his torso in order to maintain his head and his face above water. A system of straps maintains the life jacket with a thoracic or ventral belt and anterior fasteners at the ends of both branches of the U and by at least one posterior fastener at the base of the U behind the neck, wherein the fasteners are attached to the belt. In normal situation, the life jacket is not inflated. In use, the life jacket is inflated, wherein the life jacket can be inflated using a compressed gas cylinder and/or by mouth. If using a compressed gas cylinder, inflating can be triggered either manually or automatically, wherein a triggering device senses the presence of water.

These life jackets are safety elements that must be checked regularly from the point of view of their tightness as well as the operation of the inflating members. These are also relatively expensive devices. On the other hand, in certain professional activities, for example fishing, it is necessary to wear safety equipment and in particular a life jacket, failing which the employee and the employer may be held liable for any accident. Still, although the life jackets have been improved enormously as well as regards their putting on as their comfort, certain employees prefer doing without them. Similarly in leisure activities, it is desirable to wear this type of equipment. It is therefore necessary to have life jackets that while remaining efficient, adhering to the safety standards, are simple to put in place, comfortable and, especially, necessary, since the users cannot do without them.

Besides, certain maritime activities may give rise to numerous incidents liable to damage life jackets, for example for a fisherman, who may be stung by a fish hook, the friction of a cable . . . It is therefore desirable to have life jackets that can be worn continuously and hence for prevention purposes, but that are relatively protected against external environment.

Finally, people in the maritime world are generally fitted with work dresses or high trousers, which are watertight and resistant clothes that protect them against an environment that may be aggressive. Later, the words high trousers are used in order to designate these different types of clothing that have in common at least one front extension above the waist, toward the thorax, of the user, wherein the front extension is then called a front flap. However, we shall also consider the high trousers fitted with a rear flap, i.e. on the user's back.

SUMMARY OF THE INVENTION

This invention therefore suggests safety shoulder straps for high trousers, wherein the shoulder straps integrate a life jacket, wherein the shoulder straps and the life jacket must be placed in position in order to hold the trousers.

The invention comprises therefore safety straps for high trousers integrating a life jacket, wherein the life jacket is integral with a belt by at least one belt fastener, the trousers comprise at least one front flap and are held in position by straps.

According to the invention, the straps consist of a cover and of the inflatable life jacket, wherein the life jacket and the cover are generally shaped like an inverted U, in normal situation the cover envelops the life jacket between an internal layer against the user and an external layer opposed to the former, wherein the layers are connected along the internal edge of the U and removable fasteners are provided along the layers on the external edge of the U to allow quick opening of the cover; at the front the straps are fixed toward the top of the flap by two removable antero-lateral fasteners, wherein the antero-lateral fasteners are connected on the external layer of the cover at a distance from the extremities of both branches of the U; at the rear of the straps are fixed toward the top of the trousers by at least one removable postero-median fastener, wherein the postero-median fastener is connected to the base of the U provided on the rear and lateral sections of the user's neck; and the trousers comprise approximately at the waist loops intended for accommodating the belt, wherein each extremity of both branches of the U contain the corresponding belt fastener.

In diverse embodiments of the invention, the following means, taken individually or in all their technically possible combinations, are implemented:

- the loops are provided on the internal face of the trousers;
- the extremities of the belt are accessible to the user on the external face of the trousers more or less on the user's side for buckling by a belt clasp;
- the extremities of the belt are accessible to the user on the external face of the trousers toward the front median section by a belt clasp to ensure tightness at the belt clasp that is overlapped by the front flap, wherein at least one loop is provided on either side of the belt clasp between the belt clasp and the corresponding belt fastener (when fastening and closing the belt, the front flap is not placed on the front of the user's thorax and the user can still access the extremities of the belt);
- the belt is removable;
- the belt fasteners comprise loops, wherein the belt runs through the loops;
- the postero-median fastener and the belt fasteners are connected to the life jacket in connection zones, wherein the postero-median fastener runs through an opening of the internal layer of the cover;
- the life jacket and the cover are furthermore connected together at least in the following zones:

a connection zone of the postero-median fastener on the life jacket, a connection zone of the belt fasteners on the life jacket;

- the straps are adjustable, wherein at least one of the following means is implemented;

both antero-lateral fasteners are adjustable in length, the postero-median fastener is adjustable in length, both antero-lateral fasteners are made of an elastic material, the postero-lateral fastener is made of an elastic material;

- the antero-lateral fasteners are of the quick opening and closing type;
- the postero-lateral fastener is of the quick opening and closing type;
- the antero-lateral and postero-median removable fasteners comprise quick opening and closing means of specific shape preventing the use of straps other than the life jacket straps of the invention;

the antero-lateral and postero-median removable fasteners are incompatible together in order to prevent any inversion of the fastening direction of the straps;

the antero-lateral and postero-median removable fasteners are of male and female types, reverted with respect to one another in order to prevent any inversion of the fastening direction of the straps;

the removable fasteners arranged along the layers on the external edge of the U are of the VELCRO® type.

The invention also relates to high trousers comprising at least one front flap and held in place by straps, at the front the straps are fixed toward the top of the flap due to two removable antero-lateral fasteners and at the rear the straps are fixed toward the top of trousers thanks to a postero-median fastener.

According to the invention, the trousers comprise means according to any of the features listed previously and intended to accommodate straps according to any of the previous features.

Thanks to the invention, the trousers' wearer must be fitted with a life jacket, failing which the trousers cannot be held in place. This device whose purpose is to hold the trousers in lieu of the conventional straps used on this type of high clothing, exhibits the particularity of accommodating a floating jacket folded in such a fashion that it can be integrated without any problems in its cover that serves as straps. The jacket can be triggered manually or automatically and has, preferably and in order to meet the European standards, a floatability of at least 150 Newtons. The life jacket is connected to the belt by fasteners, consequently the belt is one of the essential safety elements. This connection enables catching the shipwrecked person by the life jacket and/or a strap or handle on the front of the user without the safety unit moving dangerously or even, which is more serious, slipping above the user's head. The device according to the invention forms therefore an assembly of the safety harness type that comprises a towing handle and that sustains loads along the applicable standards.

Finally, as the different fasteners are removable, on the one hand, the trousers can be put on by the user in various manners, whereas the straps are loosened only at the front or only at the rear or still totally loosened. On the other hand, in case when the trousers should be damaged or did not suit the usage contemplated. It is possible to preserve the straps and to change only the trousers for new ones or for ones of another type (if the fisherman becomes a regatta sailor for instance).

Within the framework of the invention, the expression postero-median fastener also concerns a single dorsal fastener as well as a set of dorsal fasteners, and, for example, two.

BRIEF DESCRIPTION OF THE DRAWINGS

This invention will be understood better when reading an embodiment given for exemplification and non limiting purposes where.

DETAILED DESCRIPTION OF THE INVENTION

Figure 1:
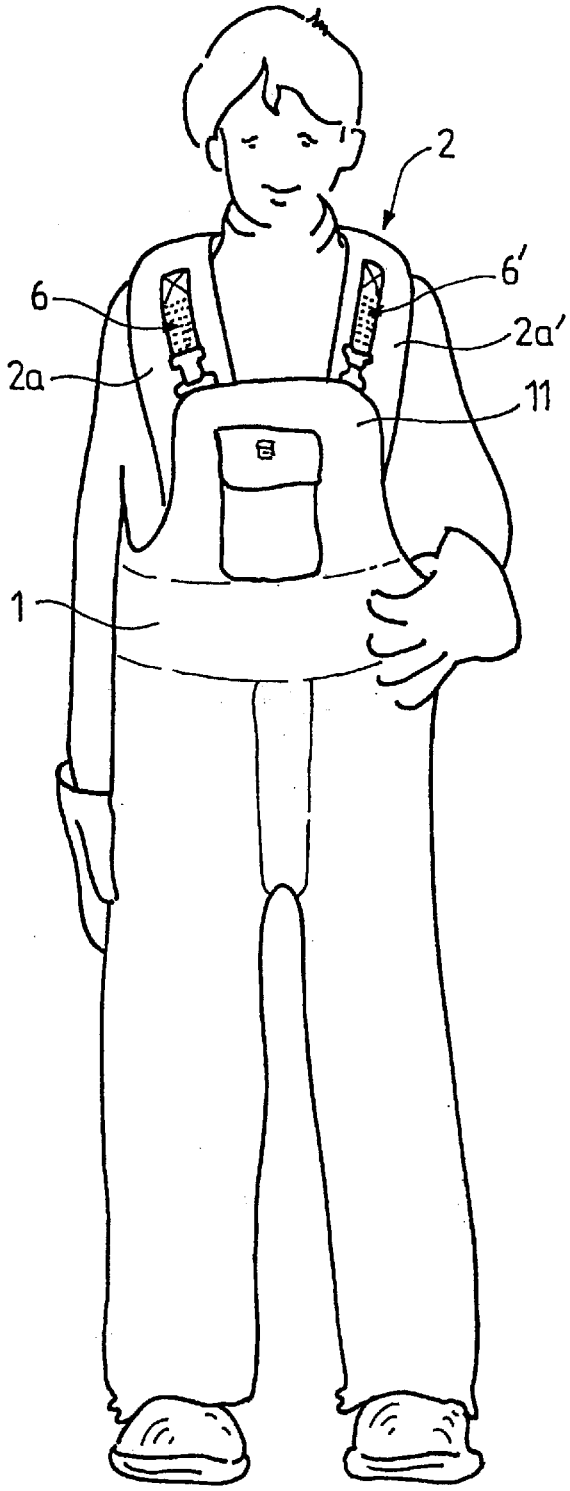
FIG. 1 represents a user fitted with a work dress according to the invention.

In FIG. 1, the user is fitted with high trousers 1 extending toward the front by a flap 11. The trousers 1 are held in place by straps 2 that are fixed in a removable fashion at the front of the flap 11 by two antero-lateral fasteners 6 and 6'.

Figure 2:
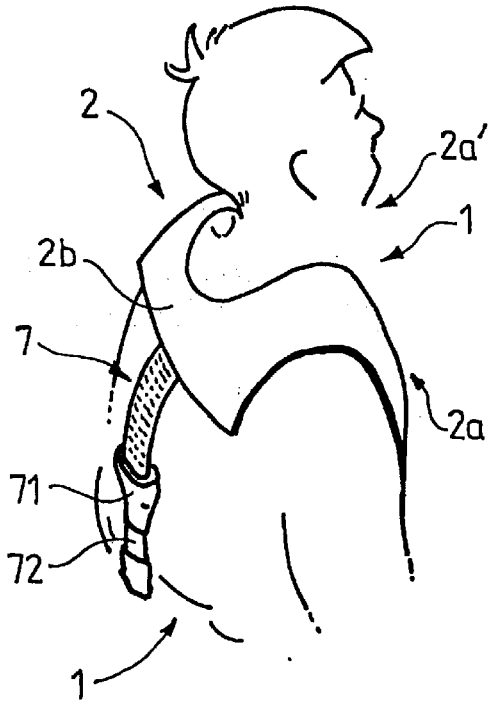
FIG. 2 represents trousers with the straps on a user seen as a rear profile.

FIG. 2 enables visualizing the rear portion of the straps 2. The straps have a general inverted U shape. Both branches 2*a* and 2*a'* of the U are intended to be placed laterally on the user's thorax and the base 2*b* of the U behind his neck. A postero-median fastener 7 is fixed at the base 2*b* for better maintenance between the base 2*b* and trousers 1 via two sections of fasteners 71 and 72. In this example, the trousers do not exhibit any extension upward behind the user. Still, in other embodiments of the invention, trousers with extensions upward behind the user, for example a posterior flap, are also usable, wherein an adjustable means of the length of the postero-median fastener enables adjusting the straps on the trousers.

Figure 3:
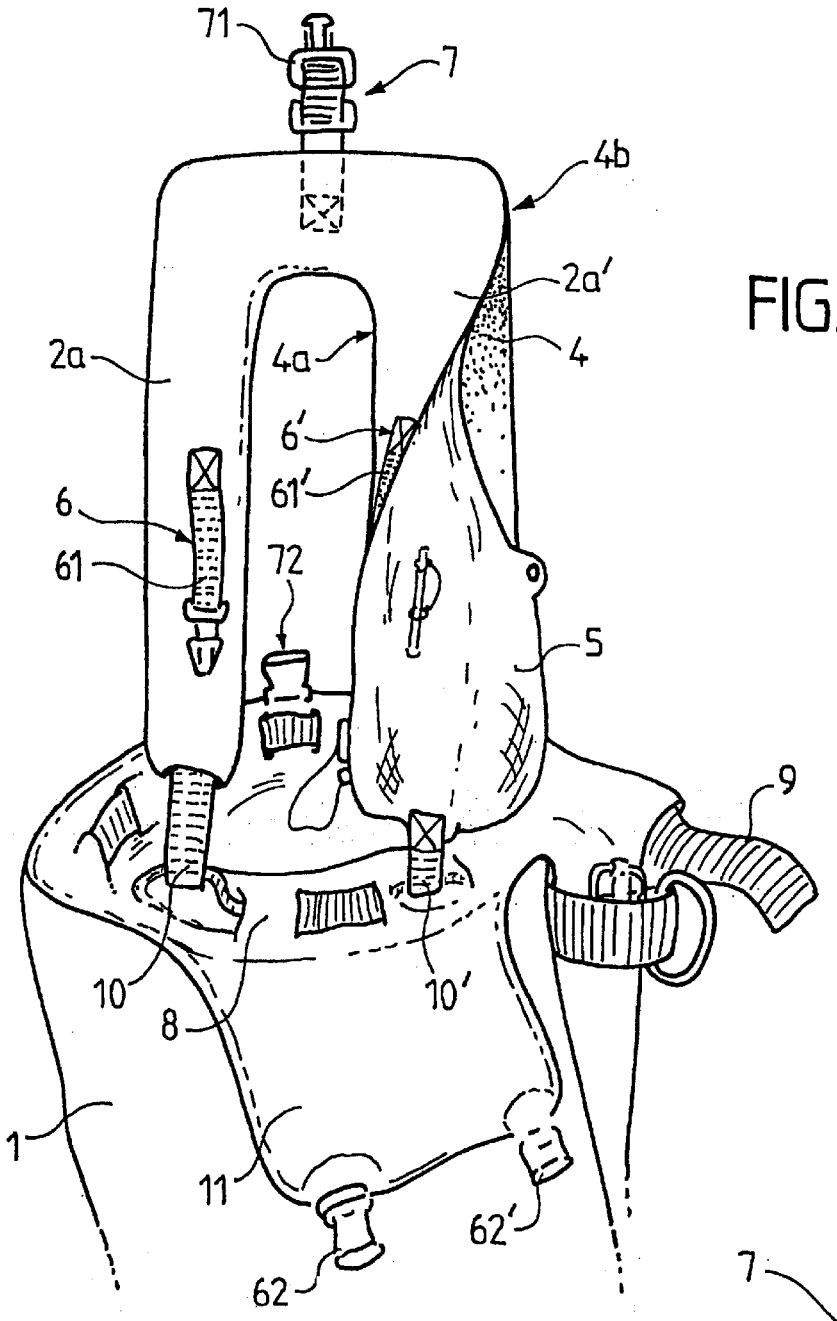
FIG. 3 represents trousers as a front view with the detail of the straps.

FIG. 3 shows the detailed constitution of the straps 2. These straps consist of a cover 4 inside which is arranged a life jacket 5. The cover consists of an internal layer placed in contact with the user and an external layer opposed to the user. The life jacket 5 is enveloped between the internal and external layers of the cover 4, wherein the layers are connected at the internal edge 4*a* of the U. Conversely, the external edge 4*b* of the layers is closed by one or several quick opening and closing devices, for instance of VELCRO® type. In normal situation, the life jacket 5 is placed deflated and folded inside the cover 4. On the right portion of FIG. 3, both layers of the cover have been separated along the external edge 4*b*, the corresponding removable fasteners having been separated, in order to expose the life jacket 5 that is partly unfolded and that exposes a mouth-inflatable device as well as a whistle.

The antero-lateral fasteners 6 and 6' are fixed to the external layer of the cover 4. The postero-median fastener 7 is fixed to the life jacket 5, wherein an opening through the internal layer of the cover enables extraction of the fastener 7. Belt fasteners 10, 10' are fixed to both extremities of the branches of the U on the life jacket 5. Each extremity of the belt fasteners 10 and 10' comprises at least one loop 8 through which a belt 9 runs. Besides, the trousers 1 comprise loops internally through which the belt 9 runs as well. In the embodiment represented, the belt is closed and buckled laterally on the user's flank or side. The belt loops arranged on the trousers 1 are on the internal face of the trousers. Conversely, the clasp for buckling and closing the belt is provided on the external face of the trousers since it must be accessible. In this embodiment, the belt is removable and can be removed from the trousers.

In another embodiment, not represented, the belt is buckled on the front of the trousers more or less at the flap 11 so that the flap covers the closure and ensures tightness at the outlets of the corresponding belt loops. It is also contemplated in other embodiments that the belt fastener is a device of another type and for example that the belt comprises a hooking element on which the belt fastener is fixed in a removable fashion, wherein the belt, furthermore, can be fixed permanently in the trousers, by the hooking elements that prevent its extraction or because the belt is fastened in one or several points of the trousers. In case when hooking elements are provided on the belt, we use preferably removable devices that are incompatible with those of the antero-lateral and postero-median fasteners so that the user may not fasten the straps on the trousers 'in a lop-sided fashion'.

The antero-lateral 6 and 6' and postero-median 7 fasteners consist of two parts, respectively 61, 62 and 61', 62' and 71, 72 which can be fastened and loosened quickly from one another by snap-on type closures. The diverse fasteners can be adjustable in length in order to adapt the work dress to the user's body. Adjustment can be made by using an elastic material and/or by a strap device adjustable in length.

Figure 4:
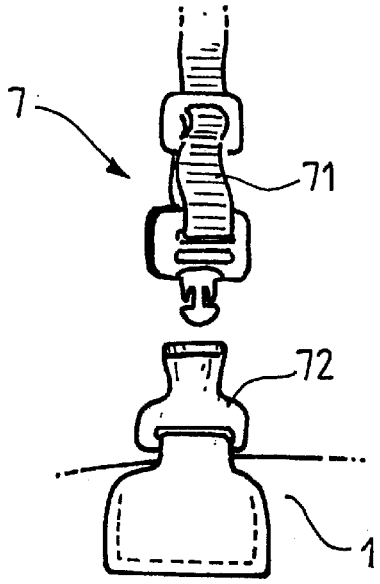
FIG. 4 represents a removable fastener.

FIG. 4 represents an example of a snap-on closure for the postero-median fastener. Besides, the fastener portion 71 is a strap adjustable in length.

The examples that have been given are purely indicative and could not limit the extent of the invention. In particular, it will be understood that the invention can be suited to any type of trousers usable in the maritime or fresh water environment.

What is claimed is:

1. Safety straps for high trousers comprising at least one front flap, the straps comprising:

an inverted U-shaped cover comprising an internal layer and an external layer;

an inverted U-shaped inflatable life jacket enveloped between the internal layer and the external layer of the U-shaped cover;

the layers are connected along an internal edge of the U-shaped cover and removable fasteners are arranged along the layers on an external edge of the U-shaped cover to enable quick opening of the U-shaped cover;

two removable antero-lateral fasteners connected to the external layer of the U-shaped cover at a distance from the extremities of both branches of the U-shaped cover and adapted to be connected to a top of the flap;

at least one removable postero-median fastener connected to a base of the U-shaped cover provided on the rear and lateral sections of the user's neck and adapted to be connected toga rear of the trousers;

a belt;

at least two belt fasteners connecting a front of the invented U-shaped life jacket to the belt, each extremity of both branches of the invented U-shaped cover and jacket contain the corresponding belt fastener;

wherein the trousers comprise waist loops intended for accommodating the belt, the loops being arranged on an internal face of the trousers; and, wherein the extremities of the belt are accessible to a user on an external face of the trousers toward a front median section by a belt clasp to ensure tightness at the belt clasp that is overlapped by the front flap, wherein at least one loop is provided on either side of the belt clasp between the belt clasp and the corresponding belt fastener.

2. The straps according to claim 1, wherein the belt is removable, the belt fasteners comprise loops and the belt runs through the loops.

3. The straps according to claim 1, wherein the postero-median fastener and the belt fasteners are connected to the life jacket in connection zones, and the postero-median fastener runs through an opening of the internal layer of the cover.

4. The straps according to claim 3, wherein the life jacket and the cover are furthermore connected together in at least one of a connection zone of the postero-median fastener on the life jacket and a connection zone of the belt fasteners on the life jacket.

5. The straps according to claim 1, wherein the straps are adjustable, wherein at least one of the following means is implemented;

both antero-lateral fasteners are adjustable in length;

the postero-median fastener is adjustable in length;

both antero-lateral fasteners are made of an elastic material; and the postero-lateral fastener is made of an elastic material.

6. The straps according to claim 1, wherein the antero-lateral fasteners comprise quick opening and closing fasteners.

7. The straps according to claim 1, wherein the postero-lateral fastener comprises a quick opening and closing fastener.

8. High trousers comprising at least one front flap and held in position by straps according to claim 1 and the trousers comprise waist loops intended to accommodate the belt, wherein the loops are provided on an internal face of the trousers, and the belt runs through the loops.

9. Safety straps for high trousers comprising at least one front flap, the straps comprising:

an inverted U-shaped cover comprising an internal layer and an external layer;

an inverted U-shaped inflatable life jacket enveloped between the internal layer and the external layer of the U-shaped cover;

the layers are connected along an internal edge of the U-shaped cover and removable fasteners are arranged along the layers on an external edge of the U-shaped cover to enable quick opening of the U-shaped cover;

two removable antero-lateral fasteners connected to the external layer of the U-shaped cover at a distance from the extremities of both branches of the U-shaped cover and adapted to be connected to a top of the flap;

at least one removable postero-median fastener connected to a base of the U-shaped cover provided on the rear and lateral sections of the user's neck and adapted to be connected to a rear of the trousers;

a belt;

at least two belt fasteners connecting a front of the invented U-shaped life jacket to the belt, each extremity of both branches of the invented U-shaped cover and jacket contain the corresponding belt fastener;

wherein the trousers comprise waist loops intended for accommodating the belt, the loops being arranged on an internal face of the trousers; and wherein the belt is removable, the belt fasteners comprise loops and the belt runs through the loops.

10. The straps according to claim 9, wherein the extremities of the belt are accessible to a user on an external face of the trousers on the user's side for buckling by a belt clasp.

11. The straps according to claim 9, wherein the extremities of the belt are accessible to a user on an external face of the trousers toward a front median section by a belt clasp to ensure tightness at the belt clasp that is overlapped by the front flap, wherein at least one loop is provided on either side of the belt clasp between the belt clasp and the corresponding belt fastener.

12. The straps according to claim 9, wherein the postero-median fastener and the belt fasteners are connected to the life jacket in connection zones, and the postero-median fastener runs through an opening of the internal layer of the cover.

13. The straps according to claim 12, wherein the life jacket and the cover are furthermore connected together in at least one of a connection zone of the postero-median fastener on the life jacket and a connection zone of the belt fasteners on the life jacket.

14. High trousers comprising at least one front flap and held in position by straps according to claim 9 and the trousers comprise waist loops intended to accommodate the belt, wherein the loops are provided on an internal face of the trousers, and the belt runs through the loops.

15. Safety straps for high trousers comprising at least one front flap, the straps comprising:

an inverted U-shaped cover comprising an internal layer and an external layer;

an inverted U-shaped inflatable life jacket enveloped between the internal layer and the external layer of the U-shaped cover;

the layers are connected along an internal edge of the U-shaped cover and removable fasteners are arranged along the layers on an external edge of the U-shaped cover to enable quick opening of the U-shaped cover;

two removable antero-lateral fasteners connected to the external layer of the U-shaped cover at a distance from the extremities of both branches of the U-shaped cover and apted to be connected to a top of the flap;

at least one removable postero-median fastener connected to a base of the U-shaped cover provided on the rear and lateral sections of the user's neck and adapted to be connected to a rear of the trousers;

a belt;

at least two belt fasteners connecting a front of the invented U-shaped life jacket to the belt, each extremity of both branches of the invented U-shaped cover and jacket contain the corresponding belt fastener;

wherein the trousers comprise waist loops intended for accommodating the belt, the loops being arranged on an internal face of the trousers; and, wherein the postero-median fastener and the belt fasteners are connected to the life jacket in connection zones, and the postero-median fastener runs through an opening of the a He internal layer of the cover.

16. The straps according to claim 15, wherein the extremities of the belt are accessible to a user on an external face of the trousers on the user's side for buckling by a belt clasp.

17. The straps according to claim 15, wherein the extremities of the belt are accessible to a user on an external face of the trousers toward a front median section by a belt clasp to ensure tightness at the belt clasp that is overlapped by the front flap, wherein at least one loop is provided on either side of the belt clasp between the belt clasp and the corresponding belt fastener.

18. The straps according to claim 15, wherein the belt is removable, the belt fasteners comprise loops and the belt runs through the loops.

19. The straps according to claim 15, wherein the life jacket and the cover are furthermore connected together in at least one of a connection zone of the postero-median fastener on the life jacket and a connection zone of the belt fasteners on the life jacket.

20. High trousers comprising at least one front flap and held in position by straps according to claim 15 and the trousers comprise waist loops intended to accommodate the belt, wherein the loops are provided on an internal face of the trousers, and the belt runs through the loops.

* * * * *